United States Patent [19]

Ulber et al.

[11] 3,949,856

[45] Apr. 13, 1976

[54] SYSTEM TO DETECT ABNORMAL PAPER FEED IN PRINTERS

[75] Inventors: Armin Ulber, Munich; Gerhard Muller, Taufkirchen, both of Germany

[73] Assignee: Siemens Aktiengesellschaft, Berlin & Munich, Germany

[22] Filed: Nov. 16, 1973

[21] Appl. No.: 416,386

[30] Foreign Application Priority Data

Nov. 29, 1972 Germany ..... 2258546

[52] U.S. Cl. ..... 197/133 R; 226/11; 226/45; 340/259

[51] Int. Cl.[2] ..... B41J 15/04

[58] Field of Search ..... 197/133 R; 226/11, 45; 340/259

[56] References Cited

UNITED STATES PATENTS

| | | | |
|---|---|---|---|
| 2,564,580 | 8/1951 | Pentecost et al. | 197/133 R |
| 2,981,396 | 4/1961 | Lane | 197/133 R |
| 2,983,356 | 5/1961 | Thompson | 197/133 R |
| 3,043,589 | 7/1962 | Folmar | 197/133 R X |
| 3,123,195 | 3/1964 | Hewitt et al. | 197/133 R |
| 3,317,157 | 5/1967 | Leiber | 197/133 R UX |
| 3,323,700 | 6/1967 | Epstein et al. | 197/133 R UX |
| 3,659,081 | 4/1972 | Piccione | 197/133 R X |
| 3,779,440 | 12/1973 | Casale et al. | 197/133 X |

*Primary Examiner*—Clifford D. Crowder
*Attorney, Agent, or Firm*—Hill, Gross, Simpson, Van Santen, Steadman, Chiara & Simpson

[57] ABSTRACT

A system for monitoring the paper feed in printing mechanisms and the like, in which reference signals are derived in response to actuation of the feeding means for the paper web and in synchronism with the feed movement thereof, which signals may be compared with supervisory signals generated in response to advancing movement of the paper web, whereby predetermined abnormal relation between the reference and supervisory signals forms a criterion of improper paper advance conditions.

1 Claim, 2 Drawing Figures

Fig. 2

SYSTEM TO DETECT ABNORMAL PAPER FEED IN PRINTERS

BACKGROUND OF THE INVENTION

The invention is directed to a system for controlling the paper feed in printing mechanisms and the like, wherein the paper web to be transported is provided with perforations adapted to receive drive pins of feeding means therefor.

In printing mechanisms, particularly high speed printers, feeding systems are employed to control the movement of the paper advance through the printing station. Such feed systems may employ feed belts or feed wheels provided with suitable transport pins which are adapted to be received in the perforations in the paper web to be transported and thereby advance such paper web.

Paper feed mechanisms of this type are subject to breakdowns in the paper advancing operation, for example as a result of ripped perforations, tearing of the paper web, jamming of the paper, and lateral derailment of the paper web at the feed mechanism. In order to efficiently shutdown the printing apparatus, in the event of such a breakdown, the failure of the paper to advance must be discovered as quickly as possible following its occurrence, in order to correspondingly stop the printing mechanism.

To endeavor to accomplish the desired results and keep the data loss occurring in such situations to within narrow limits, monitoring systems have been devised. Prior systems of this type have employed a so-called cover-closing contact. In this type of construction, each feed system for the paper web is urged against the feed belt or wheel by a hinged cover which maintains the cover-closing contact in one position indicating that proper paper advance is taking place. If a breakdown should occur in the paper advance a jamming of paper will occur which moves or tips the cover and thereby opens the cover-closing contact, actuation of which thereby indicates that a breakdown has occurred in the paper advance movement.

This type of monitoring of the paper advance has the disadvantage that, before detection of the breakdown can take place, a paper jam must first form in the paper feed system. Consequently, the invention is directed to a monitoring system for the paper feed in which a breakdown of the paper feed advance movement is immediately detected.

BRIEF SUMMARY OF THE INVENTION

The problem is solved in the present invention by the utilization of two signal generating means, one of which is synchronously controlled in correspondence to the actuation of the paper feed mechanism while the other is controlled by the advancing movement of the paper. Thus by comparing the two signals, an indication of improper advancing movement of the paper will immediately be given when the paper web fails to actuate, or improperly actuates the associated signal generating means. These results may be achieved by utilization of a suitable timing disk which is rotated synchronously with the feed mechanism and is operable to initiate reference signals, while the supervisory signals may be derived by generating means having a friction wheel, or the like, actuatable by frictional engagement of the paper web therewith, with the paper web being urged into, and maintained in engagement with such wheel by a suitable pressure roller. The friction wheel may be provided with suitable means, for example magnetic means cooperable with a suitable signal generator to produce the desired supervisory signals in accordance with the movement of the friction wheel with the reference and supervisory signals being readily compared with each other in a comparison circuit.

In a system according to the invention, the reference signals generated occur in numbers proportional to the advancing movement of the feed system, for example the advancing belt or wheel while, the supervisory signals generated occur in a number proportional to the advancing movement of the paper web. The number of reference signals and the number of supervisory signals may thus be compared with one another in a suitable comparison circuit and in the event a deviation exists between the number of reference signals and the number of supervisory signals, exceeding a predetermined limit, the paper advance movement is no longer satisfactory, and a signal may then be generated indicating a disturbance in the paper advance movement.

The comparison circuit may be readily designed in known manner from a reference to the prior art and, for example, may consist of a counter which is supplied with the reference signals as a counting frequency, while the supervisory signals will reset or release the counter to its initial condition. Thus, if the counter reading between reset signals exceeds a certain value, it is indicative that no more reset signals were supplied to the counter, thereby indicating that a disturbance occurred in the paper feed advance movement.

BRIEF DESCRIPTION OF THE DRAWING

In the drawing, wherein like reference characters indicate like or corresponding parts.

DETAILED DESCRIPTION OF THE INVENTION

Figures 1, 2:
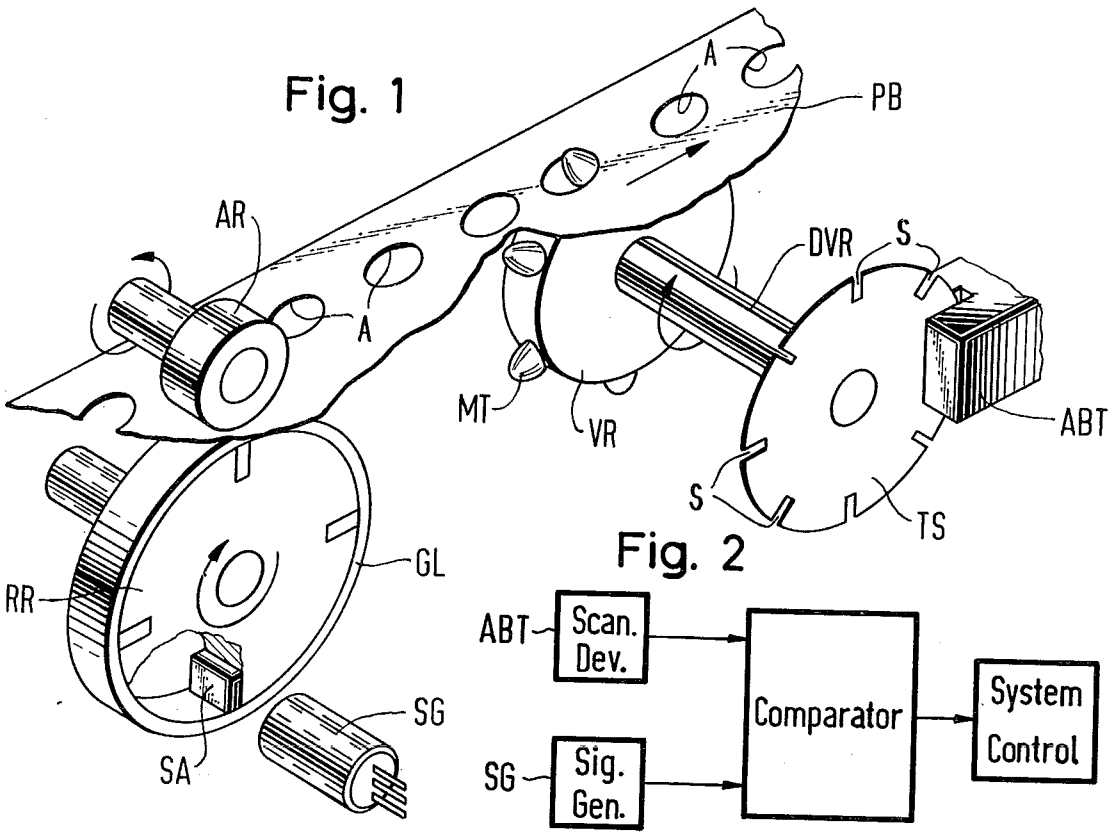
FIG. 1 is a perspective view of a portion of a paper web and advance mechanism therefor and illustrating the components of the invention.
FIG. 2 is a schematic figure in block form, of a simple circuit applicable to the present invention.

Referring to FIG. 1 of the drawing, the paper web PB is provided with a plurality of apertures or feed perforations along one edge adapted to receive drive pins MT carried by a rotatable feed wheel VR.

Carried by and rotated with the shaft DVR, carrying the feed wheel VR, is a timing disk TS which thus rotates synchronously with the feed wheel VR. Cooperable with the disk TS is a scanning device ABT which scans the movement of the disk TS and generates reference signals, as determined by the slots S therein, in a number proportional to the feed advance of the feed wheel VR.

Disposed for engagement with the paper web PB is a friction wheel RR with the paper web PB being urged into driving engagement with the wheel RR by a pressure roller AR. The friction wheel RR, in the embodiment of the invention illustrated, carries four signal generating members SA, which, for example, may comprise ferro-magnetic blocks, cooperable with a signal transmitter SG, which scans the movement of the respective blocks SA relative thereto, and generates supervisory signals in response to such movement, the number of which is proportional to the rotation of the wheel RR. However, as such wheel RR is driven by the advancing movement of the paper web PB, the number of supervisory signals also is proportional to the advancing movement of the paper web PB. The signal transmitter SG may, for example, be in the form of a magnetic differential field sensor which is commercially procurable. As illustrated, the friction wheel RR may be provided with a suitable rubber friction facing GL.

It will be appreciated that as long as the paper web PB is being properly advanced, a synchronism will exist between the number of reference signals and the number of supervisory signals occurring. Thus, assuming that a suitable counter is employed as the comparator, the counter may be arranged to count the reference signals with the supervisory signals being employed as release or reset signals. In such case, if the number of reference signals counted exceed a predetermined normal number as determined by the number of slots in the timing disk TS and the number of blocks SA in the friction wheel RR, an indication is given that the paper feed advance is disturbed.

It will be appreciated that the invention is equally applicable to mechanisms employing feed belts as the advancing means.

FIG. 2 illustrates in a block form a simple circuit for use in conjunction with the structure illustrated in FIG. 1, in which the scanning device ABT and signal generator SG are operatively connected to a comparator which, upon predetermined comparison results, transmits a signal to suitable apparatus or circuitry, generally designated "System control" in FIG. 2, for suitably controlling the paper feed. Details of such circuitry form no part of the present invention and any one of many known systems may be employed to provide the desired control, for example by the use of suitable relays or other components responsive to the output of the comparator.

It will be noted that the monitoring system in accordance with the present invention makes it possible to immediately detect breakdowns in the paper advance movement. Likewise, this also is true even though a cover of the feed system may be either open or not completely closed. Further, the invention enables the condition "end of paper" to be readily and easily detected. It will also be appreciated that the monitoring system is inherently fail-safe as an electrical or mechanical failure of the monitoring system will also result in a deviation between the number of reference signals and the number of supervisory signals.

Having thus described our invention, it will be apparent that various immaterial modifications might be suggested by those versed in the art, it should be understood that we wish to employ within the scope of the patent warranted herein all such modifications as reasonably and properly come within the scope of our contribution to the art.

We claim as our invention:

1. A system for monitoring the paper feed means of printing mechanisms and the like, in which a paper web to be transported is provided with feed perforations for the reception of drive pins of such paper feed means, comprising signal generating means in the form of a timing disc rotatable in synchronism with the advancing movement of such paper feed means, and a scanning device cooperable with said timing disc operable to generate said reference signals in response to rotation of said timing disc, means for generating supervisory signals in correspondence to the advancing movement of such a paper web, under normal web movement, in predetermined relation to said reference signals, said supervisory signal-generating means comprising a smooth surfaced rotatable wheel arranged for frictional engagement with such a paper web, a smooth surfaced pressure roller arranged to press such a paper web in driving engagement with said rotatable wheel whereby said wheel will be rotated by advancing movement of such a paper web through frictional engagment of said wheel therewith, said rotatable wheel being provided with signal-producing means comprising a plurality of ferro-magnetic blocks circumferentially spaced on said rotatable wheel, a signal transmitter arranged to scan said signal producing means comprising a magnetic differential field sensor cooperable with said blocks as said rotatable wheel rotates, and a comparator circuit arranged to compare the reference and supervisory signals, operable to provide an output signal in the presence of a predetermined abnormal relation between the compared signals, which output signal may be employed to actuate control means for the paper feed means.

* * * * *